United States Patent [19]

Deinlein-Kalb

[11] 4,026,327

[45] May 31, 1977

[54] RAPID OPENING VALVE FOR STEAM-OPERATED POWER DEVICES

[75] Inventor: Hans Deinlein-Kalb, Nurnberg, Germany

[73] Assignee: AEG-Kanis Turbinenfabrik GmbH, Nurnberg, Germany

[22] Filed: July 22, 1975

[21] Appl. No.: 598,025

Related U.S. Application Data

[63] Continuation-in-part of Ser. No. 432,099, Jan. 9, 1974, Pat. No. 3,958,600.

[30] Foreign Application Priority Data

July 24, 1974 Germany ..... 2436090

[52] U.S. Cl. ..... 137/630; 251/29

[51] Int. Cl.[2] ..... F16K 17/10

[58] Field of Search ..... 137/630, 219, 485, 489.5, 137/490, 492.5, 492, 221, 222, 220; 251/29

[56] References Cited

UNITED STATES PATENTS

| | | | |
|---|---|---|---|
| 558,794 | 4/1896 | Ford | 137/491 |
| 1,357,837 | 11/1920 | Bouvier | 137/489 |
| 1,637,825 | 8/1927 | Klann | 137/630 |
| 2,619,112 | 11/1952 | Renick | 137/490 |
| 2,914,079 | 11/1959 | Hertrich | 137/219 |
| 3,036,587 | 5/1962 | Silver | 137/219 |
| 3,825,026 | 7/1974 | Salerno | 137/219 |
| 3,958,600 | 5/1976 | Kalb | 137/630 |

*Primary Examiner*—Alan Cohan
*Attorney, Agent, or Firm*—Spencer & Kaye

[57] ABSTRACT

A rapid opening valve assembly has a housing in which there is positioned a cylinder body slidably receiving, in a cylinder chamber, a valve piston which maintains the valve assembly in an open or closed state. The valve piston has an axial extension which constitutes a spindle and which is received in a spindle chamber formed in the cylinder body. The valve piston is urged into the closed position by a spring, the force of which is opposed by the pressure in the high pressure side of the valve assembly, seeking to move the valve piston away from its seat. In the valve piston there is provided a servochamber which receives a slidable servopiston cooperating with a servovalve seat also carried by the valve piston. The servopiston is urged against its seat by a servospring, the force of which is opposed by the cylinder chamber pressure admitted to an end face of the servopiston through a channel provided in the valve piston. The servochamber communicates with the spindle chamber by a channel passing through the spindle. A conduit connects the high pressure side with the spindle chamber. An auxiliary valve which is arranged in the conduit, has a first position in which the spindle chamber is pressurized from the high pressure side and a second position in which the spindle chamber is depressurized. A rapid opening of the valve piston is effected when the auxiliary valve is switched from its first position to its second position.

6 Claims, 3 Drawing Figures

RAPID OPENING VALVE FOR STEAM-OPERATED POWER DEVICES

CROSS REFERENCE TO RELATED APPLICATION

The present application is a continuation-in-part of co-pending application Ser. No. 432,099, filed Jan. 9, 1974 now U.S. Pat. No. 3,958,600.

BACKGROUND OF THE INVENTION

This invention relates to a combined starting and shutoff device for stream and gas turbines and more particularly concerns a rapid opening valve for steam turbines. The control valve itself is fluid-pressure operated and controlled by means of an auxiliary valve. In the starting and rapid shutoff systems which serve steam turbines, there are used rapid opening valves in those steam paths where, for operational reasons, the steam flow must not be interrupted even for a short period.

The function of the rapid opening valve is that upon intentional or unintentional actuation of the rapid shutoff valve of the turbine, the steam path is, possibly without delay, directed through a bypass around the turbine to its low pressure side. For this reason, the setting periods of the rapid opening valve must be adapted to those of the rapid shutoff valve.

By the nature, rapid opening valves are, as a rule, in use only during operational malfunctionings or during the starting and stopping phases of the steam turbine so that most of the time they are in a closed state. Conventional rapid opening valves with hydromechanical drive are therefore exposed, due to their spindle arrangements, packing devices, etc., to conditions which may adversely affect the operational safety.

SUMMARY OF THE INVENTION

It is an object of the invention to provide an improved rapid opening valve devoid of moving steam-contacting components which have to be sealed with respect to atmospheric pressure.

It is another object of the invention to provide an improved rapid opening valve of the above-outlined type which in both the open and closed state prevents steam from escaping into the atmosphere so that no danger exists regarding possible deposits on valve guides.

These objects and others to become apparent as the specification progresses are accomplished by the invention, according to which, briefly stated, the rapid opening valve assembly has a housing in which there is positioned a cylinder body slidably receiving, in a cylinder chamber, a valve piston which maintains the valve assembly in an open or closed state. The valve piston has an axial extension which constitutes a spindle and which is received in a spindle chamber formed in the cylinder body. The valve piston is urged into the closed position by a spring, the force of which is opposed by the pressure in the high pressure side of the valve assembly, seeking to move the valve piston away from its seat. In the valve piston there is provided a servochamber which receives a slidable servopiston cooperating with a servovalve seat also carried by the valve piston. The servopiston is urged against its seat by a servospring, the force of which is opposed by the cylinder chamber pressure admitted to an end face of the servopiston through a channel provided in the valve piston. The servochamber communicates with the spindle chamber by a channel passing through the spindle. A conduit connects the high pressure side with the spindle chamber. An auxiliary valve which is arranged in the conduit, has a first position in which the spindle chamber is pressurized from the high pressure side and a second positon in which the spindle chamber is depressurized. A rapid opening of the valve piston is effected when the auxiliary valve is switched from its first position to its second position.

DESCRIPTION OF THE PREFERRED EMBODIMENT

Figure 1:
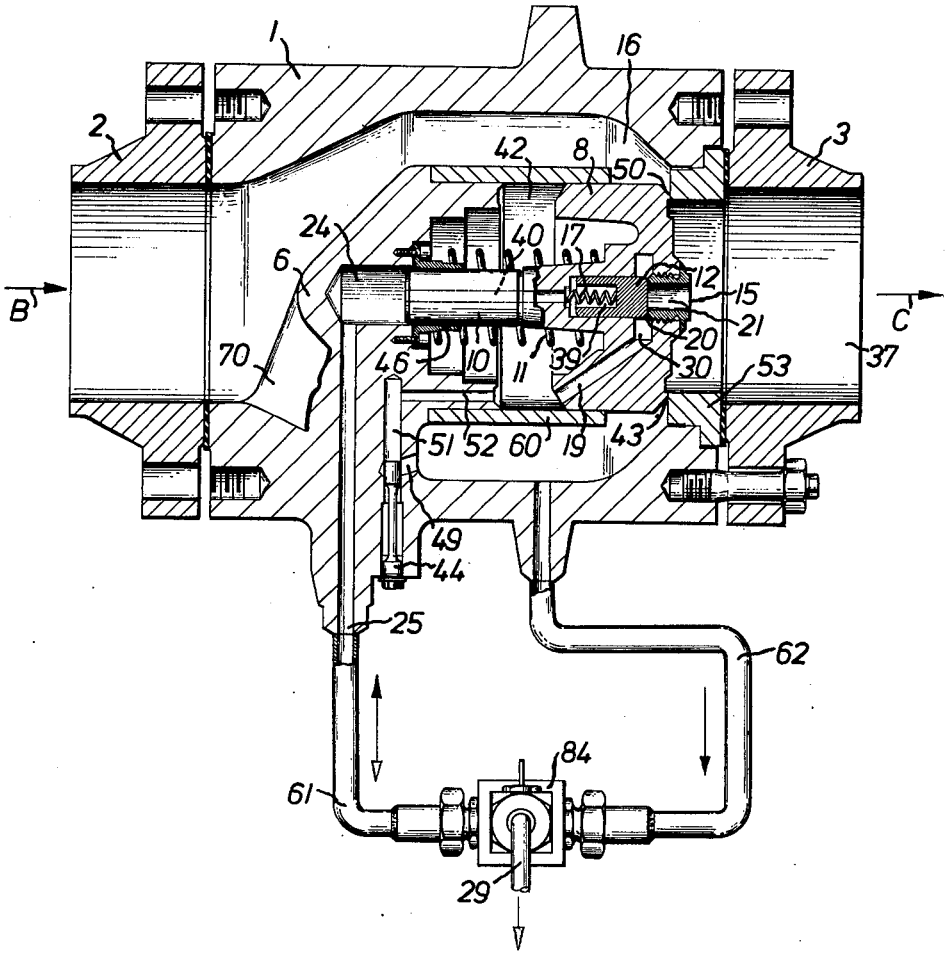
FIG. 1 is a longitudinal sectional view of a preferred embodiment of the invention.

Turning now to FIG. 1, there is illustrated a valve assembly arranged in the path of the pressurized fluid having a direction of flow indicated by arrows B and C.

The valve assembly has a tubular housing 1 arranged to ensure a substantially linear flow of the pressure medium to be controlled by the valve assembly. To the housing 1 there is flanged an inlet coupling 2 and an outlet coupling 3.

In the inner space defined by the valve housing 1 and constituting the valve inlet side (high pressure side) 16 there is positioned, coaxially with the valve housing 1, a cylinder body 6 by means of a web 70 affixed to the inside of the housing 1. The cylinder body 6 has a cylindrical guide sleeve 60 which slidably receives a valve piston 8 with a fluid-tight fit. The space enclosed by the valve piston 8 and the cylindrical guide sleeve 60 defines a cylinder chamber 42. The valve piston 8 has an annular terminal surface 50 which includes a seating face 43 cooperating with an annular valve seat member 53 clamped between a radial end face of the housing 1 and the outlet coupling 3.

The cylinder body further comprises an axial bore which constitutes a spindle chamber 24 slidably receiving a spindle 10 which forms an integral, axial extension of the valve piston 8. The valve piston 8 is urged into its closed position, that is, into engagement with the valve seat 53, by a compression spring 11 supported on an inner radial wall of the cylinder chamber 42.

The valve piston 8 is further provided with a bore which accommodates a servovalve 12, 15. The servovalve is formed of a servopiston 12 which reciprocates in the bore and which defines, with the bore, a servochamber 39. The servopiston 12 has an annular terminal surface 20 which cooperates with a servovalve seat 15 constituted by a ring-like member stationarily held in an opening of the valve piston 8, aligned with the servopiston 12. The servopiston 12 is urged into its closed position, that is, into an engagement with the seat 15, by means of a compression spring 17. An axial channel 40 provided in the spindle 10 maintains continuous communication between the spindle chamber 24 and the servochamber 39.

The servochamber 39 is enlarged into an annular pressure chamber 30 which is disposed immediately upstream of the outlet side 21 of the servovalve 12, 15 and which continuously communicates with the cylinder chamber 42 by a channel 19 provided in the valve piston 8.

The high pressure side 16 of the valve assembly is connected with the spindle chamber 24 by means of a control conduit 62 to which there is attached a control conduit 61 with the interposition of an auxiliary valve 84. The control conduit 61 is coupled to a channel 25 which is provided in the valve housing 1 and which opens into the spindle chamber 24.

Figure 1A:
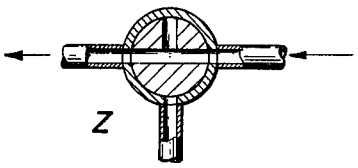
FIGS. 1*a* and 1*b* are symbolic illustrations on different positions of an auxiliary valve forming part of the preferred embodiment.
Figure 1B:
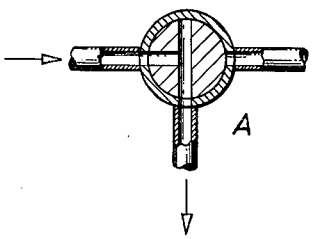

The auxiliary valve 84 has a "Z" position as illustrated in FIG. 1*a* and an "A" position as shown in FIG. 1*b*. In the "Z" position the auxiliary valve maintains communication between the conduits 61 and 62. In the "A" position, on the other hand, communication between the conduits 61 and 62 is blocked, but communication is maintained between the conduit 61 and a discharge conduit 29.

The cylinder chamber 42 communicates with the high pressure side 16 of the valve assembly by means of bypass ports 49, 51 and 52 provided in the valve housing 1. The port 49 is controlled by an adjustable throttle screw 44.

In the description that follows, the operation of the above-discussed valve assembly will be set forth.

Turning once again to FIG. 1, when the pressure medium enters, in the direction of arrow B, into the tubular valve housing 1, and the valve piston 8 is in the closed position (that is, it engages the seat 53), there will be a pressure buildup also in the spindle chamber 24. Such pressure buildup in the spindle chamber 24 is effected by the pressurized fluid (steam) passing through the control conduit 62, the auxiliary control valve 84 (which is in the position shown in FIG. 1*a* ) and the control conduit 61. Similarly, a pressure buildup will take place in the cylinder chamber 42 by virtue of steam admission through the bypass ports 49, 51 and 52.

By means of the above-described pressure conditions the valve piston 8 is, with its sealing face 43, urged against the valve seat ring 53 with increased force and similarly, the servopiston 12 is urged into contact with the seat 15. As a result, no pressure medium can flow from the high pressure side 16 to the low pressure side 37.

If now the auxiliary control valve 84 is, hydraulically or electrically, switched from its position "Z" (FIG. 1*a* ) to its position "A" (FIG. 1*b* ) and thus the pressure in the spindle chamber 24 is relieved through the conduits 25, 61 and 29, the pressure of the fluid which prevails in the pressure chamber 30 (thus exerting a force on the annular face 20 of the servopiston 12) and which is introduced thereinto through the channel 19 from the cylinder chamber 42 overcomes the biasing force of the compression spring 17 and moves the servopiston 12 into its open position.

Since the servovalve 12 is now in an open position, the pressure medium can flow from the cylinder chamber 42 to the low pressure side 37 which simultaneously leads to a pressure reduction in the cylinder chamber 42. Due to this pressure reduction, the unchanged pressure force prevailing in the valve housing 1 and affecting the annular face 50 of the valve piston 8 can now overcome the closing force of the piston spring 11 and the pressure in the cylinder chamber 42 and thus moves the valve piston 8 with switching characteristics into its open position. By setting the throttle by means of the throttle screw 44, the counterpressure in the cylinder chamber 42, taken from the inlet side 16, may be set and thus the opening acceleration of the valve piston may be adjusted to a desired limit.

The servopiston 12 and the valve piston 8 are, on their spring-loaded side, provided with axial packings which prevent any pressure medium from passing through the control conduits 25, 61 and 29 in the terminal open position of the piston 8.

The valve closing is introduced by switching the auxiliary valve 84 inot the switching position "Z". As a result, the pressure medium flows from the control conduits 62, 61 and 25 into the spindle chamber 24. In this manner first the servopiston 12 is brought into its closed position and immediately the cylinder chamber 42 is filled with the pressure medium through the clearance in the spindle guide. The clearance in the spindle guide is formed by the smaller external diameter of spindle 10 as against the bore of spindle guide 46.

As the pressure in the cylinder chamber 42 has reached a predetermined value, the valve piston 8 is moved from its open terminal position into the closed position with switching characteristics by the piston spring 11 and by the force of the pressure medium introduced into the cylinder chamber 42 through the channels 49, 51 and 52 and through the clearance of the valve piston guide. The clearance in the piston guide is formed by the fact that piston 8 in the guide section of this guide sleeve 60 has a smaller guiding diameter than the internal guiding diameter of the guide sleeve 60.

All moving valve components as well as the bearing locations in the housing are made of heat resistant meterial and are tempered. The compression springs may be made for example of a nimonic alloy in which case they are designed for temperatures of up to 560° C.

The valve assembly described and illustrated is particularly advantageous by virtue of its short structural length and the straight-line stream path which is effected gy the tube-shaped form of the housing 1 and by the cylinder 6 supported in the housing 1 by the web 70. As an alternative solution to the embodiment shown in FIG. 1, the rapid opening valve also may have an elbow structure. The annular face 50 acting in opening direction, and influenced by the initial pressure in chamber 16, is formed by the stepped diameter of valve piston 8 to the effect that the guiding diameter of piston 8 in cylinder 6, especially in the guide sleeve 60, is larger than the effective diameter of valve seat 43.

It will be understood that the above description of the present invention is susceptible to various modifications, changes and adaptations, and the same are intended to be comprehended within the meaning and range of equivalents of the appended claims.

What is claimed is:

1. A rapid opening valve assembly arranged in the path of flow of a pressurized fluid and having a valve housing provided with an inlet and an outlet for the fluid flow; a valve seat held in the housing at the valve outlet; a movable valve member cooperating with the valve seat and having a closed, seated position and an open, unseated position; the valve housing defining a space upstream of the movable valve member that constitutes the high pressure side of the valve assembly and a space downstream of the movable valve member that constitutes the low pressure side of the valve assembly; the improvement comprising in combination:

a. a cylinder body held in said valve housing at said high pressure side; said cylinder body including a cylindrical guide sleeve;

b. a valve piston slidably received in said guide sleeve for being guided by the latter in its reciprocation towards and away from said valve seat; said valve piston constituting said movable valve member; said valve piston having an annular end face exposed to the pressure in said high pressure side;

c. a cylinder chamber surrounded by said guide sleeve and bounded by said valve piston;

d. a valve spring disposed in said cylinder chamber for continuously urging said piston towards said valve seat, said valve spring opposing the force exerted on said annular end face of the valve piston and derived from the pressure in said high pressure side;

e. means defining a bore in said cylinder body; said bore extending from said cylinder chamber;

f. a spindle constituting an integral axial extension of said valve piston and slidably received in said bore;

g. a spindle chamber constituted by said bore and bounded by a free end face of said spindle;

h means defining an axial bore in said valve piston;

i. a servovalve accommodated in said axial bore of said valve piston, said servovalve including 1. a seat member;
2. a servopiston slidable in said axial bore to assume a closed position in which it engages said seat member and an open position in which it is spaced from said seat member; said servopiston having an annular end face;
3. a servochamber constituted by said axial bore and bounded by said servopiston;
4. a servospring disposed in said servochamber for continuously urging said servopiston towards said seat member;

j. throttled bypass means maintaining communication between said high pressure side and said cylinder chamber;

k. means defining a channel in said valve piston; said channel maintaining continuous communication between said cylinder chamber and said annular end face of said servopiston for exposing said servopiston to a force opposing the force of the servospring; said channel maintaining communication between said cylinder chamber and said low pressure side through said seat member of said servovalve in said open position of said servopiston; said communication between said cylinder chamber and said low pressure side being blocked by said servopiston in its said closed position;

l. means maintaining continuous communication between said spindle chamber and said servochamber;

m. conduit means connecting said high pressure side of said valve assembly with said spindle chamber; and n. an auxiliary valve arranged in said conduit means; said auxiliary valve having a first position in which communication is maintained between said high pressure side and said spindle chamber for generating the same pressure in said spindle chamber that prevails in said high pressure side; said auxiliary valve having a second position in which communication is blocked between said high pressure side and said spindle chamber and in which said spindle chamber is depressurized.

2. A rapid opening valve assembly as defined in claim 1, wherein said means maintaining continuous communication between said spindle chamber and said servochamber is constituted by a channel extending longitudinally through said spindle.

3. A rapid opening valve assembly as defined in claim 1, further comprising an adjustable throttle device disposed in said bypass means for controlling the fluid flow therein.

4. A rapid opening valve assembly as defined in claim 1, further comprising a pressure chamber formed of an enlargement of said axial bore in said valve piston, said channel being arranged in said valve piston to mainitain continuous communication between said pressure chamber and said cylinder chamber and, in the open position of said servopiston, between said cylinder chamber and said low pressure side through the seat member cooperating with said servopiston.

5. A rapid opening valve assembly as defined in claim 1, wherein said valve piston has a stepped configuration having a first portion of relatively large diameter ad a second portin of a relatively small diameter; said valve piston being held in said guide sleeve by said first portion; and annular end face of said valve piston being situated on the end face of a projecting part of said valve piston.

6. A rapid opening valve assembly as defined in claim 1, wherein said valve housing a tubular shape, said inlet and said outlet are in axial alignment and said cylinder body is supported by means of a web in axial alignment with said inlet and said outlet.

* * * * *

UNITED STATES PATENT OFFICE

CERTIFICATE OF CORRECTION

Patent No. 4,026,327 Dated May 31, 1977

Inventor(s) Hans Deinlein-Kalb

It is certified that error appears in the above-identified patent and that said Letters Patent are hereby corrected as shown below:

On the cover sheet, under Item [73] should read

-- [*] Notice: The term of this patent subsequent to May 25, 1993 has been disclaimed.--.

Signed and Sealed this

Twenty-seventh Day of September 197

[SEAL]

Attest:

RUTH C. MASON
Attesting Officer

LUTRELLE F. PARKER
Acting Commissioner of Patents and Trademark